US009073730B2

(12) United States Patent
Arcati

(10) Patent No.: US 9,073,730 B2
(45) Date of Patent: Jul. 7, 2015

(54) DECK BOX

(75) Inventor: Peter Arcati, Dillsburg, PA (US)

(73) Assignee: THE AMES COMPANIES, INC., Camp Hill, PA (US)

( * ) Notice: Subject to any disclaimer, the term of this patent is extended or adjusted under 35 U.S.C. 154(b) by 908 days.

(21) Appl. No.: 12/256,770

(22) Filed: Oct. 23, 2008

(65) Prior Publication Data

US 2010/0102157 A1 Apr. 29, 2010

(51) Int. Cl.
*B65H 75/30* (2006.01)
*B65H 75/40* (2006.01)
*B65H 75/44* (2006.01)

(52) U.S. Cl.
CPC ..... *B65H 75/40* (2013.01); *B65H 75/4407* (2013.01); *B65H 2701/33* (2013.01); *B65H 75/4471* (2013.01)

(58) Field of Classification Search
USPC ..... 242/397.4, 397.1–397.3, 397, 395; 137/355.16, 355.26, 355.27
See application file for complete search history.

(56) References Cited

U.S. PATENT DOCUMENTS

| | | | | |
|---|---|---|---|---|
| 3,977,429 | A | 8/1976 | Stevenson | |
| 4,137,939 | A | 2/1979 | Chow | |
| 4,174,809 | A * | 11/1979 | Arlemark | 239/745 |
| 4,506,698 | A | 3/1985 | Garcia et al. | |
| 4,512,361 | A | 4/1985 | Tisbo et al. | |
| RE32,150 | E | 5/1986 | Rice | |
| 4,768,546 | A | 9/1988 | Brusadin et al. | |
| 4,777,976 | A | 10/1988 | Johnston et al. | |
| 4,974,627 | A | 12/1990 | Nelson | |
| 5,007,598 | A | 4/1991 | Spear et al. | |
| 5,046,520 | A | 9/1991 | Sanchez, Jr. et al. | |
| 5,056,553 | A | 10/1991 | Whitehead et al. | |
| 5,388,609 | A * | 2/1995 | Ghio et al. | 137/355.27 |
| 5,425,391 | A | 6/1995 | Tisbo et al. | |
| 5,988,207 | A * | 11/1999 | Kownacki et al. | 137/355.27 |
| 6,050,291 | A | 4/2000 | Whitehead et al. | |
| 6,742,740 | B2 * | 6/2004 | Tisbo et al. | 242/395 |
| 6,834,670 | B2 | 12/2004 | Rosine et al. | |
| 6,877,687 | B2 * | 4/2005 | Moon et al. | 242/390.8 |
| 6,908,058 | B2 * | 6/2005 | Moon et al. | 242/403.1 |
| 6,913,221 | B2 * | 7/2005 | Moon et al. | 242/390.8 |
| 6,973,750 | B1 * | 12/2005 | Kim | 43/23 |
| 7,017,603 | B1 | 3/2006 | Rosine et al. | |
| 7,377,289 | B1 | 5/2008 | English et al. | |
| 7,438,250 | B2 * | 10/2008 | Anderson et al. | 242/395 |
| 7,575,188 | B2 * | 8/2009 | Mullen et al. | 242/405.2 |
| 2007/0144584 | A1 * | 6/2007 | Hatcher et al. | 137/355.26 |

* cited by examiner

*Primary Examiner* — Sang Kim
*Assistant Examiner* — Juan Campos, Jr.
(74) *Attorney, Agent, or Firm* — Eckert Seamans Cherin & Mellot, LLC; David C. Jenkins

(57) ABSTRACT

A hose reel assembly wherein the crank assembly/handle is directly coupled to the basket assembly or barrel is provided. This configuration allows for rotational energy, provided by the user, to be directly transferred to the basket assembly. Thus, energy loss due to friction in the gears is reduced. The hose reel assembly further includes a transfer assembly that couples the crank assembly to the autotrack device. The transfer assembly may include a gear, a belt, a chain or similar devices structured to transfer rotational motion from one component to another.

12 Claims, 5 Drawing Sheets

DECK BOX

BACKGROUND OF THE INVENTION

1. Field of the Invention

This invention relates to hose reels and, more specifically, to a deck box hose reel having a direct drive and an autotrack assembly.

2. Background Information

Hose reel assemblies are devices structured to assist in transporting and using hoses, typically garden hoses for dispensing water. Generally, the hose reel assembly includes a base or housing assembly structured to rotatably support a reel, or "basket assembly." The basket assembly's primary components are a barrel, around which an outlet hose is wrapped, two hubs which are coupled to the housing assembly, and guide plates which define the usable area of the barrel. The basket assembly also includes a crank, used to turn the basket primary components, and a water conduit having a movable outlet and a generally stationary inlet. The stationary inlet of the conduit extends away from the reel and is structured to be coupled to a supply hose which is further coupled to a water supply. The movable outlet of the conduit is disposed on the circumference of the reel. The outlet hose is coupled to the movable outlet and is used to deliver water to the end use. Hose reel assemblies also may include an autotrack device structured to wind the outlet hose on the reel in a controlled manner. In this configuration, an outlet hose may be coupled to the movable end of the conduit and, when the reel is rotated, the hose is wrapped, or unwrapped, about the reel. Thus, a hose may be transported and/or stored on the hose reel assembly.

Because the basket assembly is centrally disposed in the housing assembly, which is a relatively low location when the deck box is on the ground, hose reels typically include a handle having a geared hub that is disposed at a higher elevation on the housing assembly. One or more gears operatively link the handle to the basket assembly so that rotational motion in the handle is transferred to the basket assembly. Additional gears link the handle assembly to the autotrack device and cause the autotrack device to translate as required for the controlled placement of the hose on the basket assembly.

SUMMARY OF THE INVENTION

The concept disclosed and claimed below relates to a hose reel wherein the crank assembly/handle is directly coupled to the basket assembly or barrel. This configuration allows for rotational energy, provided by the user, to be directly transferred to the basket assembly. Thus, energy loss due to friction in the gear assembly is reduced. Further, the prior art gear assemblies, which were typically made from plastic, were prone to becoming jammed. By eliminating the gears between the crank assembly and the basket assembly, these problems are reduced. The concept further includes a transfer assembly that couples the crank assembly to the autotrack device. The transfer assembly may include a gear, a belt, a chain or similar devices structured to transfer rotational motion from one component to another.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

As used herein, "coupled" means a link between two or more elements, whether direct or indirect, so long as a link occurs.

As used herein, "directly coupled" means that two elements are directly in contact with each other.

As used herein, "fixedly coupled" means that two components are coupled to move in a fixed relationship, i.e. to move as a single component.

As used herein, "removably fixedly coupled" means that two components are coupled to move in a fixed relationship, i.e. to move as a single component, but may also be decoupled from each other.

As used herein, the phrase "tension member" means a member capable of supporting a load while in tension, but which is generally flexible under a compressive force.

As used herein, "operatively engage" when used in reference to gears, or other components structured to transfer rotational motion, means that the components engage each other in a manner so that when one component rotates the other component must rotate as well.

As used herein, directional terms, e.g., "above," "below," "upper," "lower," etc., are used for convenience relative to the Figures and are not intended to limit the claims.

Figure 1:
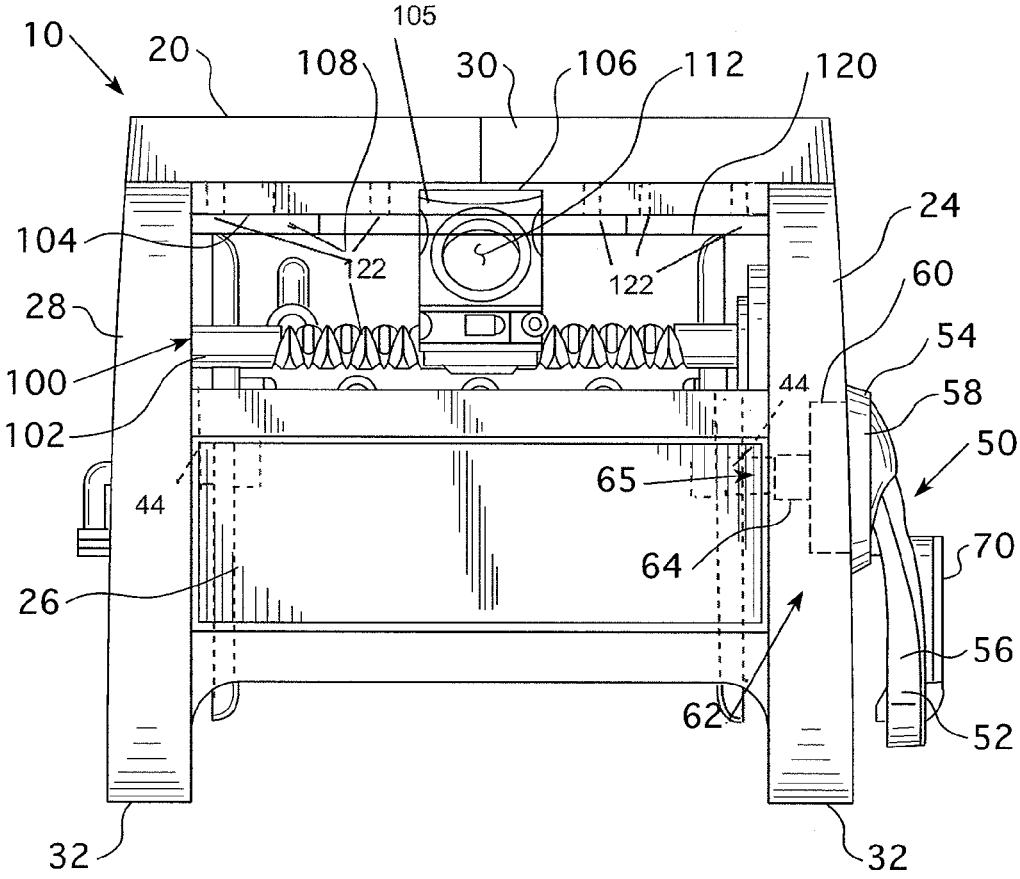
FIG. 1 is a back view of a hose reel.
Figure 2:
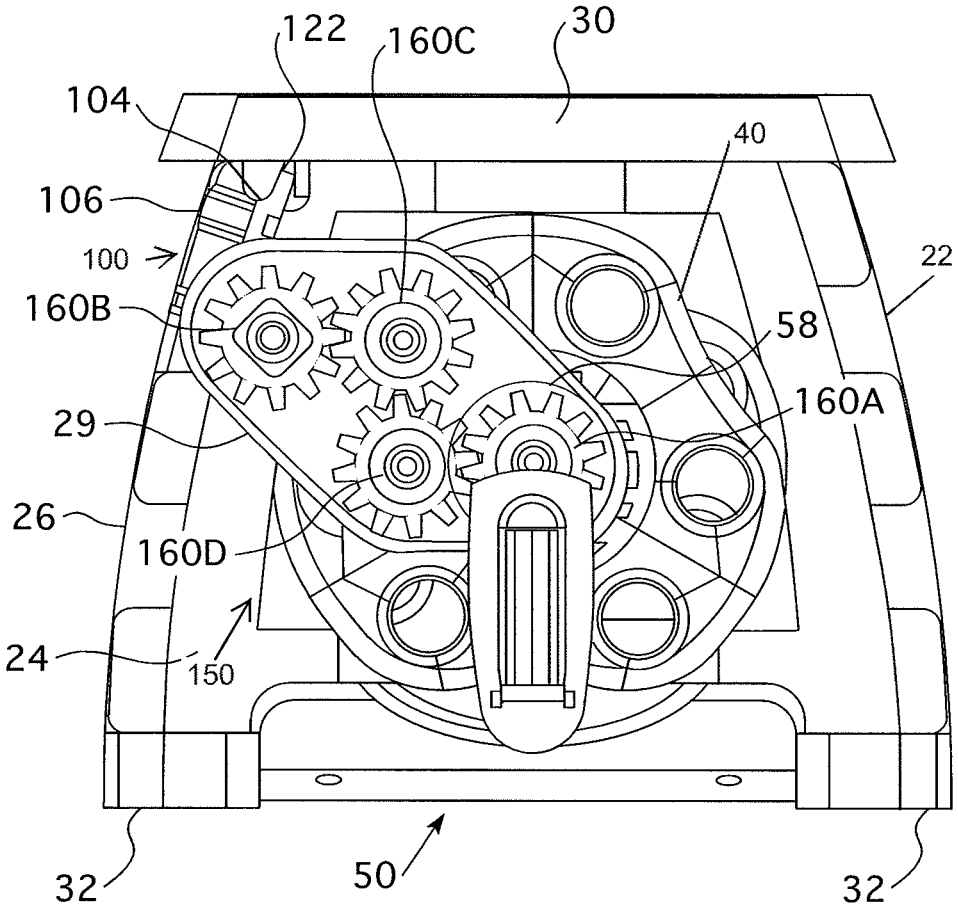
FIG. 2 is a cross-sectional side view of a hose reel.

As shown in FIGS. 1 and 2, a hose reel assembly 10 includes a housing assembly 20, a basket assembly 40, and a transfer assembly 150. The housing assembly 20, preferably, includes a front side 22, a first lateral side 24 (FIG. 1), a back side 26, a second lateral side 28 (FIG. 2), a top member 30, and an autotrack device 100 (FIG. 2). The front side 22 and the back side 26 are each coupled to the first and second lateral sides 24, 28 and disposed in a spaced, generally parallel configuration. The first and second lateral sides 24, 28 are also disposed in a spaced, generally parallel configuration. Thus, the housing assembly 20 is generally a rectangular shape. A foot 32 is located at each corner of the housing assembly 20. The autotrack device 100 is disposed adjacent to the back side 26 and is discussed below. The transfer assembly 150 is structured to transfer a rotational motion to the autotrack device 100 from the basket assembly crank assembly 50, described below.

Figure 3:
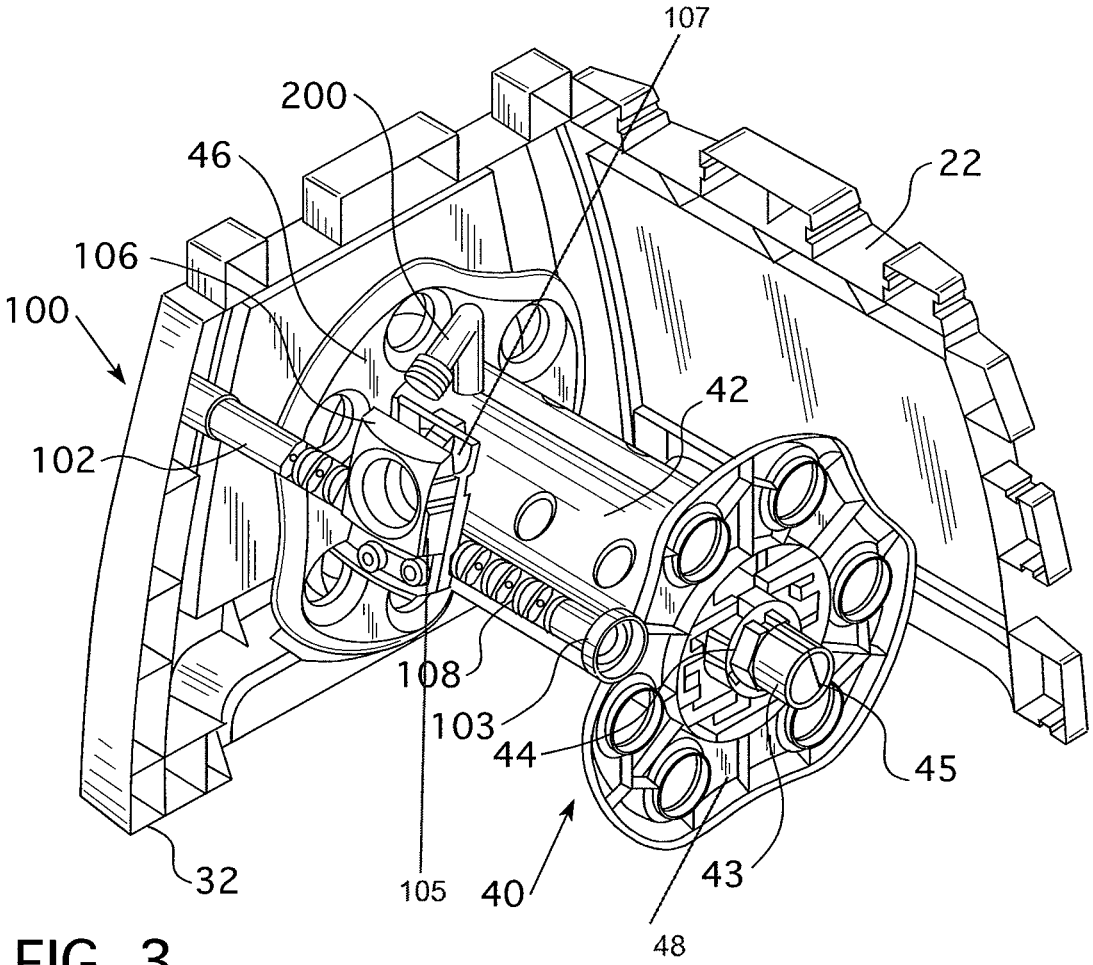
FIG. 3 is a partial isometric view of a hose reel.
Figure 4:
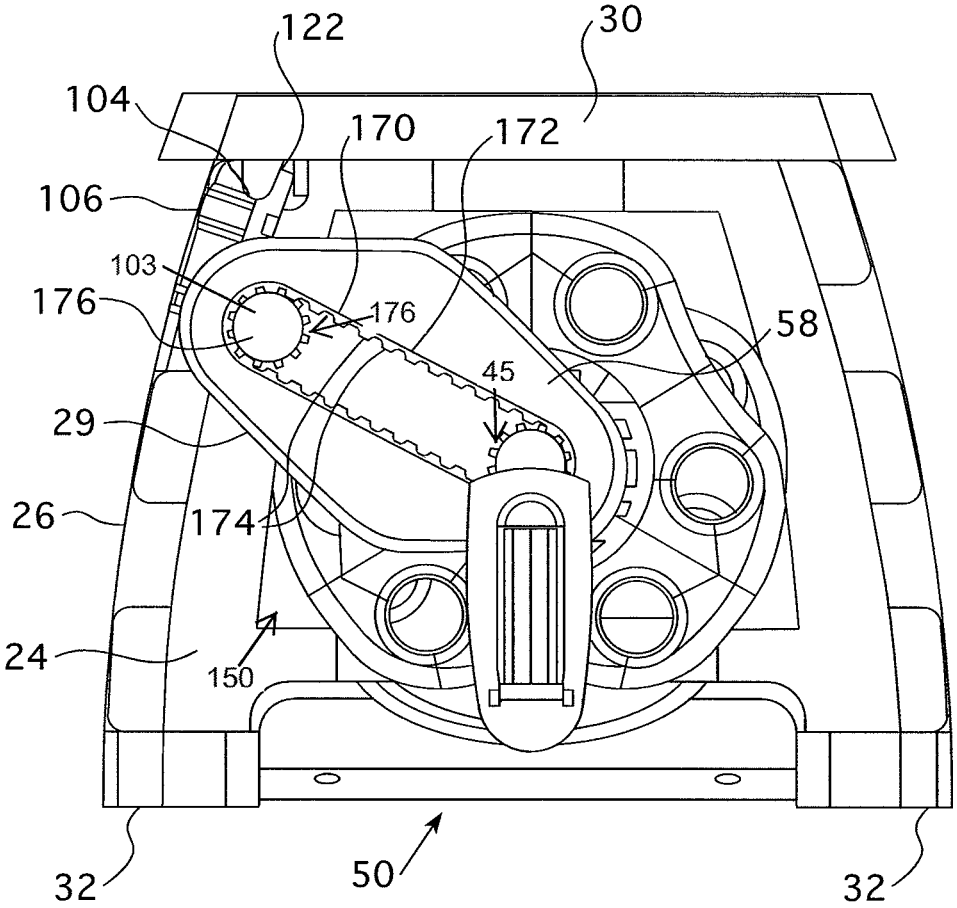
FIG. 4 is a side view of an alternate transfer assembly.
Figure 5:
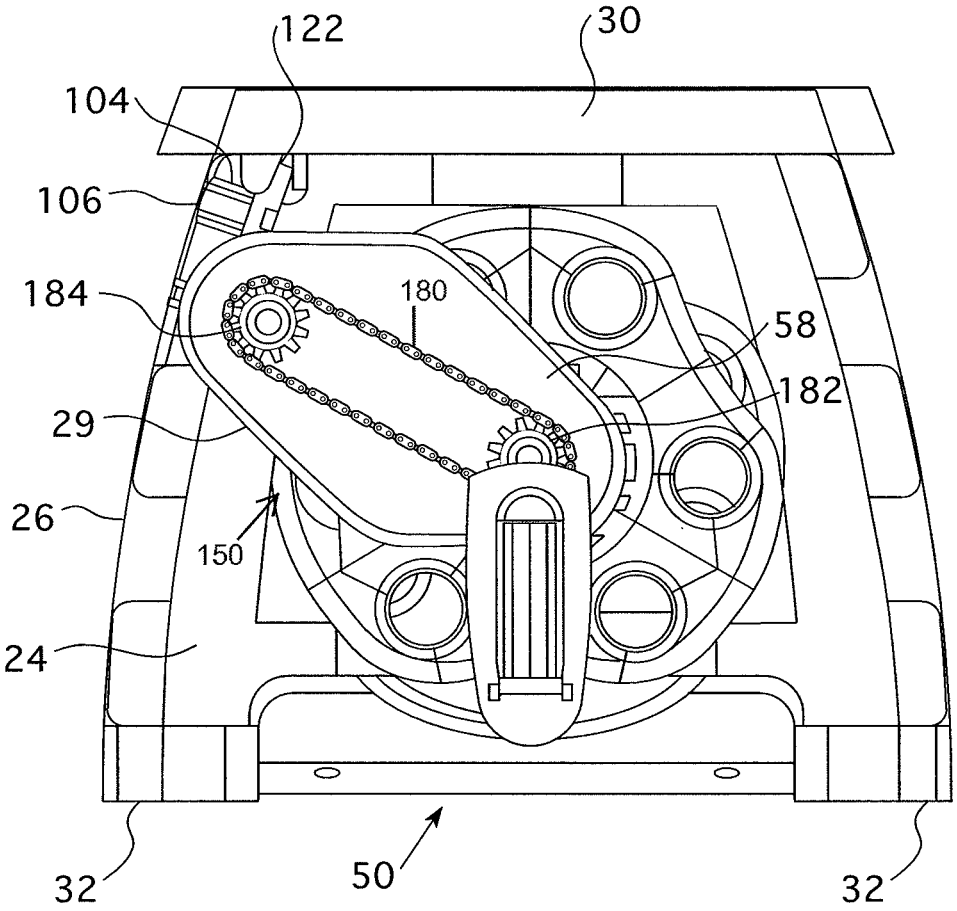
FIG. 5 is a side view of another alternate transfer assembly.

The basket assembly 40 is structured to support a hose (not shown). More specifically, the basket assembly 40 is structured to have a hose coiled thereabout and to allow the hose to be substantially coiled thereabout for storage and to feed the hose out of the hose reel assembly 10 for use. As shown in FIG. 3, the basket assembly 40 includes an elongated, generally cylindrical barrel 42 with two axial hubs 44, a crank assembly 50 (FIG. 1), and a water system 200. As is known in the art, the water system is structured to be coupled to an external hose and water source. The water system 200, as well as the autotrack device 100, are substantially similar to the water system 200 and autotrack device 100 disclosed in U.S. patent application Ser. No. 11/385,206, now U.S. Pat. No. 7,377,289, issued May 27, 2008, which is incorporated by reference. The basket assembly 40 may also include two guide plates 46, 48. One guide plate 46, 48 is disposed adjacent to each end of the barrel 42. The guide plate 46, 48 are structured to maintain the hose coiled about the barrel 42. The hubs 44 are rotatably coupled to the housing assembly 20, preferably to the first and second lateral sides 24, 28. In this configuration, the barrel 42 may be rotated about its longitudinal axis while disposed within the housing assembly 20.

The crank assembly 50 is fixedly coupled to the barrel 42 and is structured to rotate the barrel 42 within the housing assembly 20. The crank assembly 50 includes an elongated crank arm 52 and handle assembly 70. The crank arm 52 includes a base portion 54 and an elongated body 56. The base portion 54 has, preferably, an outer disk 58 and an inner hub 60. The outer disk 58 and/or the crank assembly hub 60 is structured to be disposed in a generally circular opening on the housing assembly 20. The crank assembly hub 60 includes a coupling device 62. The coupling device 62 is structured to fix the orientation of the crank assembly 50 relative to the barrel 42. As shown, the coupling device 62 is a keyed socket configuration. That is, the barrel 42 includes a lug 43 having a non-circular periphery, and preferably having at least one groove 45. The crank assembly hub 60 has a socket 64 with a cavity that substantially corresponds to the shape of the lug 43 periphery, and preferably includes at least one ridge 65 structured to be disposed in the lug groove 45. Thus, when the crank assembly socket 64 is disposed about the lug 43 with the crank assembly socket ridge 65 disposed in the lug groove 45, the crank assembly 50 must rotate at the same rate as the barrel 42. That is, the crank assembly 50 is fixedly coupled to the barrel 42. It is further noted that, while a user may use the crank assembly 50 to uncoil the hose from the barrel 42, the crank assembly 50 is typically used to take up the hose. Accordingly, for the following discussion, use of the crank assembly 50 shall be referred to in association with taking up the hose.

The autotrack device 100, shown in FIGS. 2-3, includes an elongated guide rod 102, an elongated retaining edge 104, and a follower assembly 106. The guide rod 102 and the retaining edge 104 extend in a spaced, parallel relation, and are, preferably, coupled to, and extending between, the housing assembly first lateral 24 side and second lateral side 28. The guide rod 102 has a bi-directional track groove 108 disposed thereon. As detailed in U.S. patent application Ser. No. 11/385,206, now U.S. Pat. No. 7,377,289, issued May 27, 2008, when the guide rod 102 is rotated, the follower assembly 106 translates over the guide rod 102 in a cyclical motion, i.e. the follower assembly 106 moves back-and-forth. The follower assembly 106 has a housing assembly 105 with a hose passage 112 therethrough and through which the hose extends. As detailed below, the autotrack device 100 is coupled to the crank assembly 50 so that when the crank assembly 50 and barrel 42 rotate, the autotrack device 100 moves as well. In this configuration, the autotrack device 100 causes the hose to be wrapped about the barrel 42 in a series of layers as the hose is taken up. As the hose is pulled from the barrel 42, the autotrack device follower assembly 106 merely moves back and forth on the guide rod 102 without applying a significant force to the hose.

The autotrack device retaining edge 104 is coupled to, and extends between, the housing assembly first lateral side 24 and the housing assembly second lateral side 2628. The autotrack device retaining edge 104 includes a distal end 120 and plurality of support ribs 122. The support ribs 122 extend in a direction generally perpendicular to the longitudinal axis of the retaining edge 104. The support ribs 122 are spaced apart, preferably by a distance less than the width of the follower assembly 106. The autotrack device follower assembly 106 has a retaining edge groove 107 structured to enclose a portion of the autotrack device retaining edge distal end 120. In this configuration, the autotrack device retaining edge 104 prevents the follower assembly 106 from rotating along with the guide rod 102 and ensures that the follower assembly 106 moves back and forth as the guide rod 102 rotates.

The transfer assembly 150 is structured to provide rotational motion to the autotrack device 100. That is, the transfer assembly 150 is coupled to both the crank assembly 50 and the autotrack device 100 so that, when a user actuates the crank assembly 50, the rotational motion provided thereto is transferred to the autotrack device 100 as well. As noted above, when the autotrack device 100, and more specifically, the guide rod 102 is rotated, the follower assembly 106 moves back and forth over the guide rod 102. Thus, as a user actuates the crank assembly 50, the barrel 42 rotates and the follower assembly 106 moves back and forth over the guide rod 102. This combined motion allows the hose to be coiled about the barrel 42 in a series of generally regular layers.

In one embodiment the transfer assembly 150 utilizes at least two gears 160A, 160B, and preferably a total of four gears 160A, 160B, 160C, 160C, extending between the crank arm hub 60 and the guide rod 102. The first gear 160A, or hub gear 160A, is fixed to, or incorporated with, the crank arm hub 60. Accordingly, the hub gear 160A rotates whenever the crank assembly 50 is actuated. The second gear 160B, or guide rod gear 160B, is fixed to, or incorporated with, the guide rod 102. As the hub gear 160A is disposed generally adjacent to either the housing assembly first lateral side 24 or second lateral side 28, the guide rod gear 160B is preferably disposed adjacent to the same housing assembly first lateral side 24 or second lateral side 28. The hub gear 160A and the guide rod gear 160B operatively engage each other so that when the hub gear 160A rotates, the guide rod gear 160B rotates. That is, when the crank assembly 50 is actuated, the crank arm hub 60, and therefore the hub gear 160A, rotates. This rotational motion is transferred from the hub gear 160A to the guide rod gear 160B which in turn causes the guide rod 102 to rotate. Thus, in this configuration, when the user actuates the crank assembly 50, the rotational motion provided thereto is transferred to the autotrack device 100 as well.

In a more preferred embodiment, at least one intermediate gear 160C, and more preferably two intermediate gears 160C, 160D, is/are disposed between, and operatively engaging, both the hub gear 160A and the guide rod gear 160B. Use of the at least one intermediate gear 160C allows for the gears 160A, 160B, 160C, 160D to have a smaller diameter thereby allowing the gears 160A, 160B, 160C, 160D to fit within the housing assembly 20 and reducing manufacturing costs. As before, because all the gears 160A, 160B, 160C, 160D operatively engage the adjacent gears 160A, 160B, 160C, 160D, when the user actuates the crank assembly 50, the rotational motion provided thereto is transferred to the autotrack device 100 as well. It is noted that the relative rate of rotation of the rotating components may be controlled by adapting the size of the intermediate gears 160C, 160D to achieve the desired rotational speeds.

Preferably, the housing assembly 20 includes a barrier 29 surrounding the gears 160A, 160B, 160C, 160D. The barrier 29 extends generally perpendicular to the lateral side 24, 26 adjacent to the gears 160A, 160B, 160C, 160D. The barrier 29 helps resist the ingress of dirt and other debris into the system of gears 160A, 160B, 160C, 160D.

In an alternate embodiment, the transfer assembly 150 utilizes a tension member 170. The tension member 170 is disposed between, and operatively engages both, the crank assembly 50 and the autotrack device 100 so that, when a user actuates the crank assembly 50, the rotational motion provided thereto is transferred to the autotrack device 100 as well. In one embodiment, the tension member 170 is a belt 172. The belt 172 wraps partially about, and may frictionally engage, the crank arm hub 60. The guide rod 102 may also have an enlarged hub 103 fixed thereto. The belt 172 wraps partially about, and may frictionally engage, the guide rod 102 or it's hub 103. Thus, when the user actuates the crank assembly 50, the rotational motion provided thereto is transferred to the autotrack device 100 as well.

The belt 172 may include a plurality of lateral ridges 174 on the inner surface. The crank arm hub 60 and the guide rod 102, or it's hub 103, may include a plurality of grooves 176 on each of their respective outer surfaces. The spacing of the belt lateral ridges 174 and both hub's plurality of grooves 176 have a corresponding spacing. Thus, the lateral ridges 174 are structured to operatively engage the crank arm hub grooves 176 and the autotrack device guide rod hub grooves 176. This configuration is less prone to slippage than a pure frictional engagement system.

In another embodiment, the tension member 170 is a roller chain 180 structured to operatively engage a first sprocket 182 and a second sprocket 184. The first sprocket 182, or hub sprocket 182, is fixed to, or incorporated with, the crank arm hub 60. Accordingly, the hub sprocket 182 rotates whenever the crank assembly 50 is actuated. The second sprocket 184, or guide rod sprocket 184, is fixed to, or incorporated with, the guide rod 102. The roller chain 180 extends over, and operatively engages the hub sprocket 182 and the guide rod sprocket 184. Thus, when the user actuates the crank assembly 50, the rotational motion provided thereto is transferred to the autotrack device 100 as well.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A direct drive hose reel assembly having an autotrack device, said hose reel assembly comprising:

a housing assembly;

an autotrack device, said autotrack device coupled to said housing assembly;

a basket assembly structured to be rotatably coupled to said housing assembly, said basket assembly having an elongated barrel with two axial hubs;

a crank assembly, said crank assembly fixedly coupled to said barrel and structured to rotate said barrel relative to said housing assembly;

said crank assembly including a crank arm and a transfer assembly;

said crank arm structured to be rotatably coupled to said housing assembly, said crank arm also coupled, and structured to provide rotational motion, to said transfer assembly;

said transfer assembly coupled, and structured to provide rotational motion, to said autotrack device;

said housing assembly includes a front side, back side, first lateral side, and a second lateral side;

said autotrack device includes an elongated retaining edge, a guide rod, and a follower assembly;

said autotrack device follower assembly having a housing assembly with an opening therein sized to allow a hose to pass therethrough;

said autotrack device retaining edge having a distal end;

said autotrack device follower assembly housing assembly having a retaining edge groove structured to enclose a portion of said autotrack device retaining edge distal end;

said guide rod and said retaining edge extending in a spaced parallel relation, both said guide rod and said retaining edge being coupled to, and extending between, said housing assembly first lateral side and said housing assembly second lateral side; and said autotrack device follower assembly housing assembly extending between said guide rod and said retaining edge.

2. The hose reel assembly of claim 1 wherein:

said guide rod having a bi-directional track groove disposed thereon;

said follower housing assembly structured to be coupled to guide rod and to engage said bi-directional track groove, whereby said follower assembly housing assembly is structured to traverse said guide rod as said guide rod rotates; and said transfer assembly coupled, and structured to provide rotational motion, to said guide rod.

3. The hose reel assembly of claim 2 wherein said transfer assembly includes at least one gear, said at least one gear disposed between, and operatively engaging both, said autotrack device and said crank assembly.

4. The hose reel assembly of claim 3 wherein:

said crank assembly includes a crank arm having a hub and a radially extending arm;

said crank arm hub rotatably coupled to said housing assembly;

said at least one gear includes at least a hub gear and a guide rod gear;

said hub gear fixed to said crank arm hub; and said guide rod gear fixed to said autotrack device guide rod.

5. The hose reel assembly of claim 4 wherein said at least one gear includes at least one intermediate gear, said at least one intermediate gear disposed between, and operatively engaging, both said hub gear and a guide rod gear.

6. The hose reel assembly of claim 2 wherein said transfer assembly includes a tension member, said tension member disposed between, and operatively engaging both, said autotrack device and said crank assembly.

7. The hose reel assembly of claim 6 wherein said tension member is a belt.

8. The hose reel assembly of claim 7 wherein:

said crank assembly includes a crank arm having a hub and a radially extending arm;

said crank arm hub rotatably coupled to said housing assembly;

said autotrack device guide rod having a at least one hub;

said autotrack device guide rod hub rotatably coupled to said housing assembly;

said belt structured to extend about, and operatively engage, both said crank arm hub and said autotrack device guide rod hub.

9. The hose reel assembly of claim 8 wherein:

said crank arm hub has a width extending in an axial direction and a groove on the crank arm hub outer surface, said groove extending generally parallel to the crank arm hub axis;

said autotrack device guide rod hub has a plurality of grooves on the autotrack device guide rod hub outer surface, said grooves extending generally parallel to the autotrack device guide rod hub axis;

said belt having an inner surface, said belt inner surface having a plurality of lateral ridges; and said lateral ridges structured to operatively engage said crank arm hub grooves and said autotrack device guide rod hub grooves.

10. The hose reel assembly of claim 6 wherein said tension member is a roller chain.

11. The hose reel assembly of claim 10 wherein:

said crank assembly includes a crank arm having a sprocket and a radially extending arm;

said crank arm sprocket rotatably coupled to said housing assembly;

said autotrack device guide rod having a at least one sprocket;

said autotrack device guide rod sprocket rotatably coupled to said housing assembly;

said roller chain structured to extend about, and operatively engage, both said crank arm sprocket and said autotrack device guide rod sprocket.

12. The hose reel assembly of claim 1 wherein:

said autotrack device retaining edge includes a plurality of support ribs, said support ribs extending generally perpendicular to the longitudinal axis of said autotrack device retaining edge; and said autotrack device follower housing assembly retaining edge groove sized to accommodate said support ribs.

* * * * *